US005312494A

United States Patent [19]

Horimura et al.

[11] Patent Number: 5,312,494

[45] Date of Patent: May 17, 1994

[54] HIGH STRENGTH AND HIGH TOUGHNESS ALUMINUM ALLOY

[75] Inventors: Hiroyuki Horimura; Noriaki Matsumoto; Kenji Okamoto, all of Saitama, Japan

[73] Assignee: Honda Giken Kogyo Kabushiki Kaisha, Tokyo, Japan

[21] Appl. No.: 57,071

[22] Filed: May 4, 1993

[30] Foreign Application Priority Data

May 6, 1992 [JP] Japan ..... 4-113712

[51] Int. Cl.[5] ..... C22C 21/00

[52] U.S. Cl. ..... 148/437; 148/403

[58] Field of Search ..... 148/437, 403

[56] References Cited

U.S. PATENT DOCUMENTS 4,743,317 5/1988 Skinner et al. .
4,964,927 10/1990 Shiflet et al. .
5,240,517 8/1993 Matsumoto et al. ..... 148/437

FOREIGN PATENT DOCUMENTS

339676A1 of 1989 European Pat. Off. .
460887A1 of 1991 European Pat. Off. .
460887 12/1991 European Pat. Off. ..... 148/423
4107532A1 of 1991 Fed. Rep. of Germany .
57-32349 2/1982 Japan ..... 148/437
248860 12/1985 Japan .

OTHER PUBLICATIONS

European Search Report.
Chemical Abstracts-Sep. 9, 1991 (vol. 115, No. 10) entitled "Chemistry of Synthetic High Polymers" (Cooke, D.H.).

*Primary Examiner*—Deborah Yee
*Attorney, Agent, or Firm*—Lyon & Lyon

[57] ABSTRACT

A high strength and high toughness aluminum alloy is produced by crystallization of one of two aluminum alloy blanks: one having a metallographic structure with a volume fraction Vf of a mixed-phase texture consisting of an amorphous phase and an aluminum crystalline phase being equal to or more than 50% (Vf≧50%), and the other having a metallographic structure with a volume fraction Vf of an amorphous single-phase texture being equal to or more than 50% (Vf≧50%). The aluminum alloy is represented by a chemical formula:

$$Al_{(a)}X_{(b)}Z_{(c)}Si_{(d)}$$

wherein X is at least one element selected from the group consisting of Mn, Fe, Co and Ni; Z is at least one element selected from the group consisting of Zr and Ti; and each of (a), (b), (c) and (d) is defined within the following range:

84 atomic %≦(a)≦94 atomic %,
4 atomic %≦(b)≦atomic %,
0.6 atomic %≦(c)≦4 atomic %, and
0.5 atomic %≦(d)≦(b)/3.

Si is present in the form of at least one of a solute atom of an aluminum solid solution and a component element of an intermetallic compound.

2 Claims, 5 Drawing Sheets

HIGH STRENGTH AND HIGH TOUGHNESS ALUMINUM ALLOY

BACKGROUND OF THE INVENTION

1. FIELD OF THE INVENTION

The present invention relates to a high strength and high toughness aluminum alloy, and particularly, to an improvement of aluminum alloy produced by crystallization of one of two aluminum alloy blanks: one having a metallographic structure with a volume fraction Vf of a mixed-phase texture consisting of an amorphous phase and an aluminum crystalline phase being equal to or more than 50% (Vf≧50%), and the other having a metallographic structure with a volume fraction Vf of an amorphous single-phase texture being equal to or more than 50% (Vf≧50%).

2. DESCRIPTION OF THE PRIOR ART

There are such conventionally known aluminum alloys such as Al-Fe-Zr based alloys (for example, see Japanese Patent Application Laid-open No.248860/85 and U.S. Pat. No.4,473,317).

However, the prior art aluminum alloys have a problem that they have a relatively high strength, on the one hand, and have an extremely low toughness, on the other hand, because an intermetallic compound $Al_2Fe$ is produced during the crystallization of the aluminum alloy blank.

SUMMARY OF THE INVENTION

Accordingly, it is an object of the present invention to provide an aluminum alloy of the type described above, wherein by allowing a particular amount of a chemical constituent or constituents to be contained in a particular amorphous aluminum alloy composition system, an increased toughness is achieved, not to mention a high strength.

To achieve the above object, according to the present invention, there is provided a high strength and a high toughness aluminum alloy produced by crystallization of an aluminum alloy blank having a metallographic structure selected from the group consisting of a mixed-phase texture consisting of an amorphous phase and an aluminum crystalline phase having a volume fraction equal to or greater than 50% (Vf≧50%) and an amorphous single-phase texture having a volume fraction Vf equal to or greater than 50% (Vf≧50%), wherein the aluminum alloy is represented by a chemical formula:

$$Al_{(a)}X_{(b)}Z_{(c)}Si_{(d)}$$

wherein X is at least one element selected from the group consisting of Mn, Fe, Co and Ni; Z is at least one element selected from the group consisting of Zr and Ti; and each of (a), (b), (c) and (d) is defined within the following range:

84% atomic %≦(a)≦94 atomic %,
4% atomic %≦(b)≦9 atomic %,
0.6% atomic %≦(c)≦4 atomic %, and
0.5% atomic %≦(d)≦(b)/3, and Si is present in the form of at least one of a solute atom of an aluminum solid solution or a component element of an intermetallic compound.

With the above feature, X (i.e., Mn, Fe, Co and Ni) as well as Z (i.e., Zr and Ti) are required chemical constituents for producing an aluminum alloy blank with a volume fractions Vf of a mixed-phase texture or an amorphous single-phase texture being equal to or more than 50% (Vf≧50%).

If the amorphous phase of the aluminum alloy blank containing such chemical constituents X and Z is crystallized, $Al_6Mn$, when X is Mn; $Al_6Fe$, when X is Fe; $Al_3Co$, when X is Co; or $Al_3Ni$, when X is Ni; is produced as an intermetallic compound harmful to the toughness of the aluminum alloy. At the same time, $Al_3Zr$, when Z is Zr; or $Al_3Ti$, when Z is Ti; is produced as intermetallic compound harmless to the toughness of the aluminum alloy.

Thereupon, a particular amount of Si is contained in the amorphous aluminum alloy composition system containing the above-described chemical constituents X and Z. This enables the intermetallic compounds $Al_6X$ and $Al_3X$, which are harmful to the toughness of the aluminum alloy, to be converted into a harmless intermetallic compound $X_{12}(SiAl)_{12}$, Thus, it is possible to provide an aluminum alloy with a high strength and with an increased toughness.

If the X content (b) is less than 4% atomic % ((b)<4% atomic %), or if the Z content (c) is less than 0.6% atomic % ((c)<0.6% atomic %), an aluminum alloy blank having a metallographic structure of the type described above cannot be produced. On the other hand, if the X content is greater than 9% atomic %, or if the Z content is greater than 4% atomic %, the amount of production of the intermetallic compounds $Al_6X$ and $Al_3X$, which are harmful to toughness, is increased, and for this reason, the harmful intermetallic compounds cannot be fully converted into a harmless intermetallic compound with the addition of Si. In addition, if the Z content is greater than 4% atomic %, an intermetallic compound $Al_3Z$ is liable to be produced when an aluminum alloy blank is prepared, i.e., upon quenching. To avoid this, the tapping temperature (the temperature of the molten metal as it is tapped or discharged from the furnace) must be increased resulting in an aluminum alloy blank with deteriorated properties. $Al_3Z$ is originally an intermetallic compound harmless to the toughness of the aluminum alloy, but if $Al_3Z$ is produced during quenching, it is disadvantageously coalesced at a subsequent crystallizing step.

If the Si content is less than 0.5 atomic %, the above-described effect by Si cannot be obtained. On the other hand, if (d)>(b)/3, the Si content is excessive, so that the intermetallic compound $Al_3Z$ is converted into an intermetallic compound AlZSi. AlZSi is harmful to the toughness of the alloy, and hence, the meaning of adding to the alloy Si is lost.

If the volume fractions Vf of the mixed-phase texture and the amorphous single-phase texture in the metallographic structure are less than 50% (Vf<50%), the coalesced region of the metallographic structure of the aluminum alloy is increased, resulting in reduced strength and toughness of the aluminum alloy.

Si in the aluminum alloy is present in the form of a solute atom of an aluminum solid solution or a component element of an intermetallic compound or both, and, therefore, is not present in the form of a primary crystal Si or an eutectic Si. This avoids a reduction in toughness of the aluminum alloy due to the primary crystal Si or the like.

The above and other objects, features and advantages of the invention will become apparent from the following detailed description of preferred embodiments, taken in conjunction with the accompanying drawings.

DESCRIPTION OF THE PREFERRED EMBODIMENTS

Figure 1:
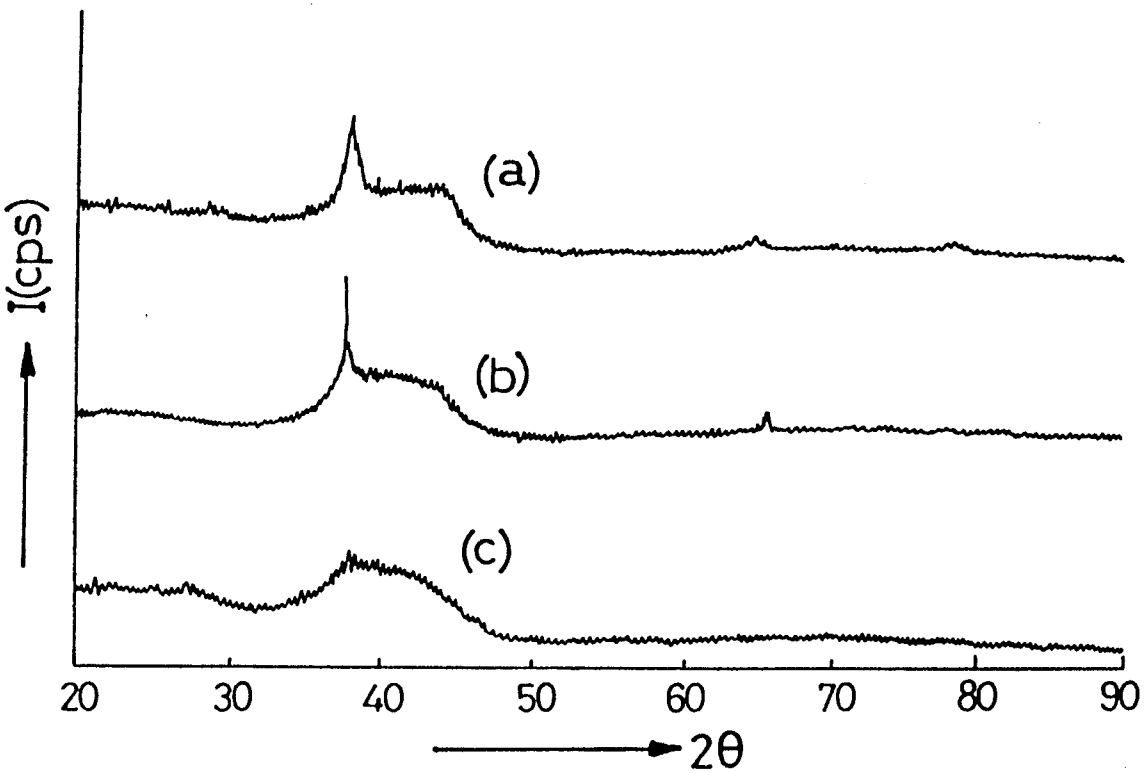
FIG. 1 is a pattern diagram of an X-ray diffraction for various aluminum alloy blanks.

The present invention will now be described by way of preferred embodiments in connection with the accompanying drawings.

[Example 1]

Table 1 shows the compositions of an aluminum alloy (1) of the present invention and two aluminum alloys (2) and (3) according to comparative examples.

TABLE 1

| Al alloy | Chemical constituent (by atomic %) | | | |
|---|---|---|---|---|
| | Al | Fe | Zr | Si |
| (1) | 87 | 8 | 3 | 2 |
| (2) | 89 | 8 | 3 | — |
| (3) | 85 | 8 | 3 | 4 |

In producing each of the aluminum alloys (1), (2) and (3), the process which will be described below was employed. A molten metal having a composition corresponding to each of the three aluminum alloys (1), (2) and (3) was prepared in an arc melting process and then used to produce each of three ribbon-like aluminum alloy blanks (1), (2) and (3) (for convenience, the same characters as the corresponding aluminum alloys (1), (2) and (3) are used) by application of a single-roll process. The conditions for this single-roll process were as follows: The diameter of a copper roll was 250 mm; the rate of revolutions of the roll was 4,000 rpm; the diameter of a quartz nozzle was 0.5 mm; a gap between the quartz nozzle and the roll was 0.3 mm; the pressure under which the molten metal was injected was 0.4 kgf/cm$^2$; and the atmosphere was an argon atmosphere under −40 cmHg.

Figure 2:
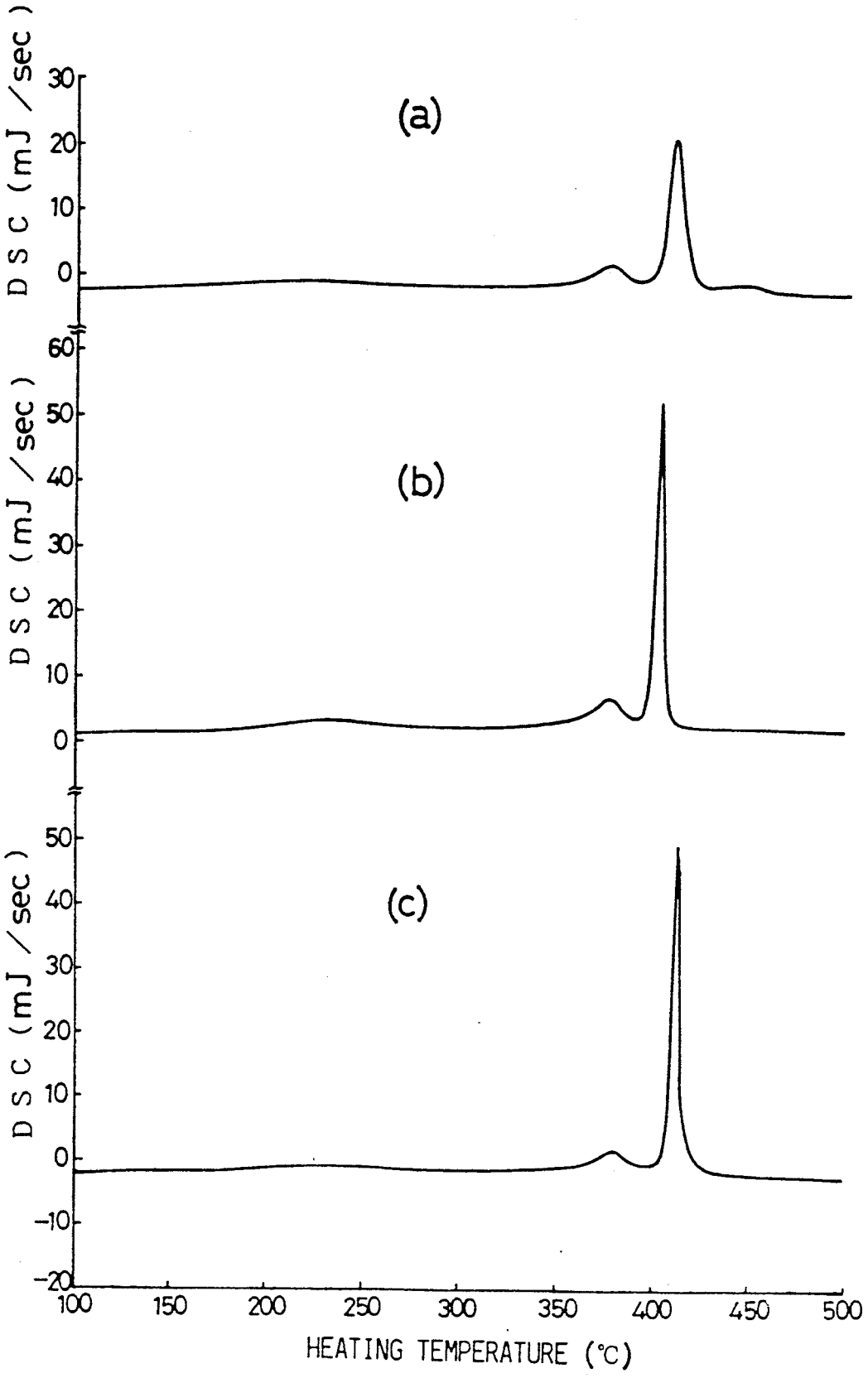
FIG. 2 is a thermocurve diagram of a differential thermal analysis for the various aluminum alloy blanks.

FIG. 1 is a pattern diagram of an X-ray diffraction for the aluminum alloy blanks (1), (2) and (3), and FIG. 2 is a thermocurve diagram of a differential scanning colorimeter (DSC) thermal analysis for the aluminum alloy blanks (1), (2) and (3). In FIGS. 1 and 2, (a) corresponds to the aluminum alloy (1); (b) to the aluminum alloy (2), and (c) to the aluminum alloy (3).

As apparent from FIGS. 1 and 2, metallographic structures of the aluminum alloys (1) and (2) are mixed-phase textures each comprising an amorphous phase and an aluminum crystal phase having a face-centered cubic lattice texture. The volume fraction Vf of the mixed-phase texture is 100% (Vf=100%). The metallographic structure of the aluminum alloy (3) is an amorphous single-phase texture whose volume fraction Vf is 100% (Vf=100%).

Then, the aluminum alloy blanks (1), (2) and (3) were subjected to a thermal treatment for one hour at a temperature in a range of 200° to 450° C., thereby crystallizing the amorphous phase to provide the aluminum alloy (1) of the present invention and the aluminum alloys (2) and (3) of the comparative examples.

Figure 3:
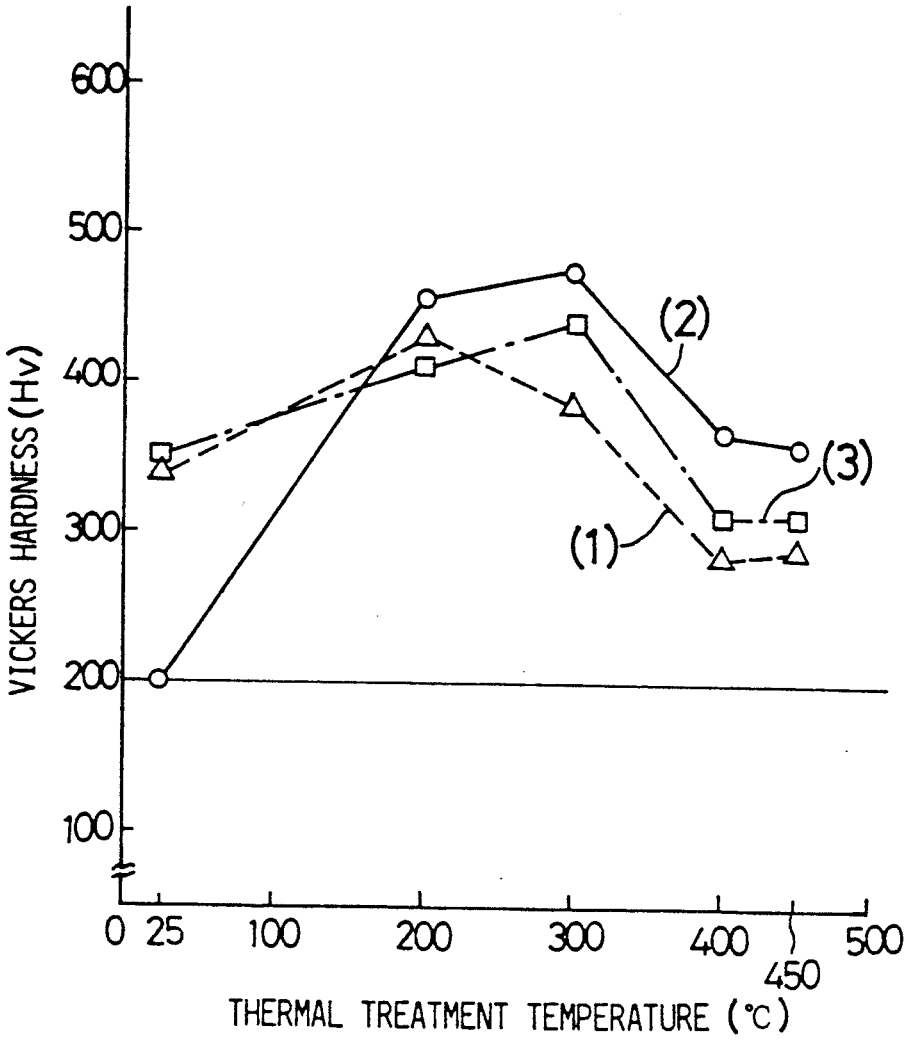
FIG. 3 is a graph illustrating the relationship between the thermal treatment temperature and the Vickers hardness for various aluminum alloys.
Figure 4:
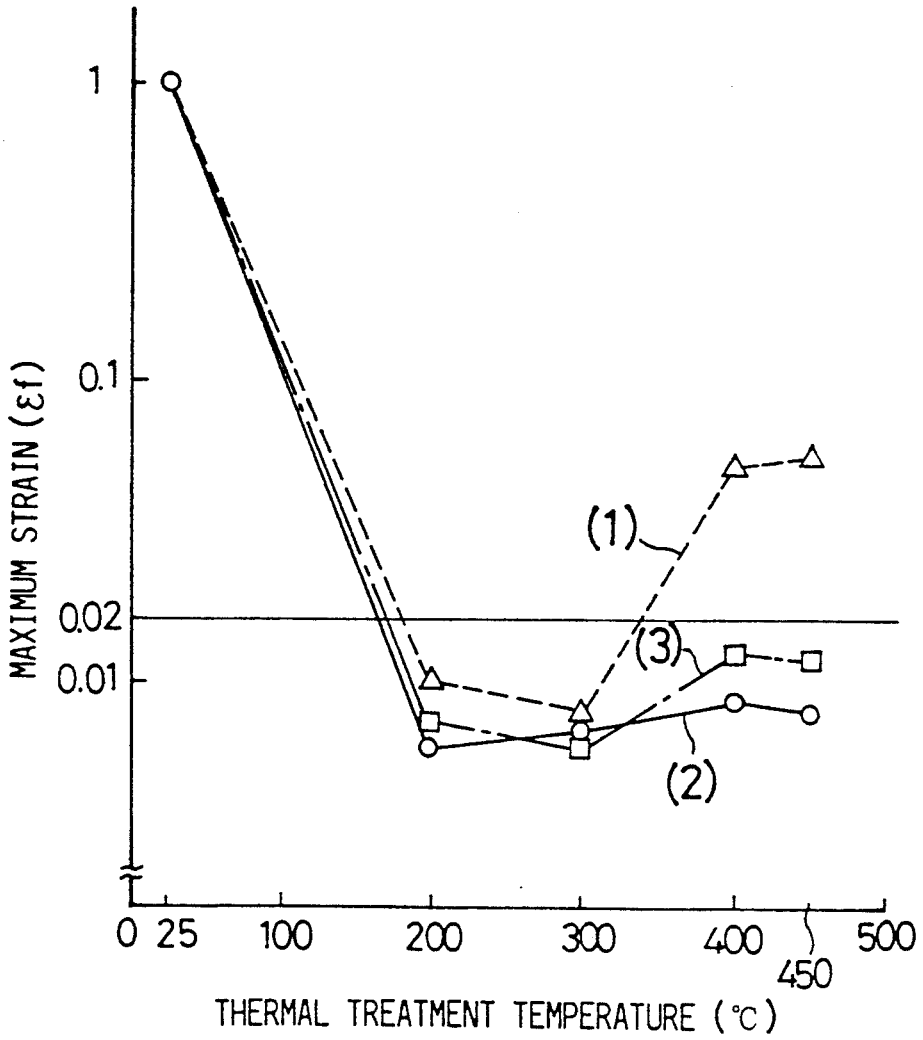
FIG. 4 is a graph illustrating the relationship between the thermal treatment temperature and the maximum strain for the various aluminum alloys.

FIG. 3 illustrates the relationship between the thermal treatment temperature and the Vickers hardness Hv for the aluminum alloys (1), (2) and (3), and FIG. 4 illustrates the relationship between the thermal treatment temperature and the maximum strain $\epsilon f$ in a flexural test for the aluminum alloys (1), (2) and (3). In both of FIGS. 3 and 4, characters indicating lines are identical with the characters indicating the aluminum alloys.

For the criterion of increasing of the strength of the aluminum alloys, the Vickers hardness Hv is set at a value equal to or more than 200 (Hv≧200). This is because the relation $Hv/3 \approx \sigma_B$ is established between the Vickers hardness Hv and the tensile strength, and, hence, if the Vickers hardness Nv of the aluminum alloy equal to or more than 200 (Hv≧200), the tensile strength $\sigma_B$ of the aluminum alloy is equal to or more than 65 kgf/mm$^2$ ($\sigma_B \geqq 65$ kgf/mm$^2$). as a result, the aluminum alloy has a high strength.

For the criterion of increasing the toughness of the aluminum alloys, the maximum strain $\epsilon f$ is set at a value equal to or more than 0.02 ($\epsilon f \geqq 0.02$). This is because if the maximum strain $\epsilon f$ of the aluminum alloy is equal to or more than 0.02 ($\epsilon f \geqq 0.02$), the % elongation of the aluminum alloy is equal to or more than 2% and as a result, the aluminum alloy has a high toughness permitting its application as a utility material.

It can be seen from FIG. 3 that the aluminum alloys (1), (2) and (3) meet a strength-increasing condition of Vickers hardness Hv≧200 at each thermal treatment temperature of 450° C.

If the maximum strain $\epsilon f$ of each of the aluminum alloys is considered in FIG. 4, the aluminum alloy (1) produced at the thermal treatment temperature of 340° C. or more of the invention satisfies the requirement $\epsilon f \geqq 0.02$, and, therefore, it can be seen that the aluminum alloy (1) has a high toughness. The aluminum alloys (2) and (3) of the comparative examples has the maximum strain $\epsilon f < 0.02$ even at the thermal treatment temperature of 340° C. or more and therefore, each of them has a low toughness.

The appearance of a difference in toughness as described above between the aluminum alloy (1) of the invention and the aluminum alloys (2) and (3) of the comparative examples is substantiated from the following data.

Figure 5:
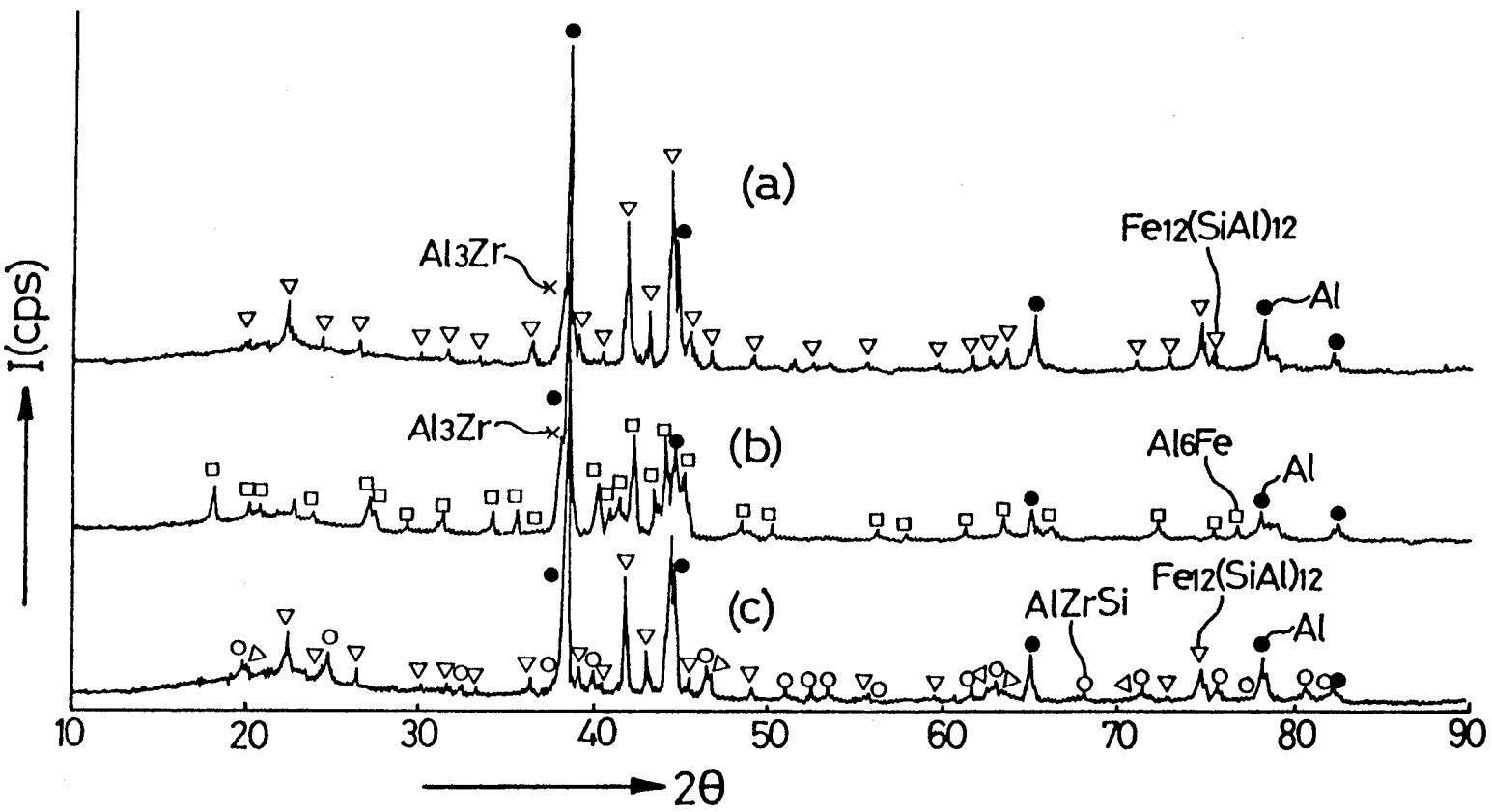
FIG. 5 is a pattern diagram of an X-ray diffraction for the various aluminum alloy blanks.

FIG. 5 is a series of X-ray diffraction pattern diagrams for aluminum alloys produced under the condition of a thermal treatment temperature of one hour, wherein (a) corresponds to the aluminum alloy (1) of the invention; (b) to the aluminum alloys (2) of the comparative examples, and (c) to the aluminum alloys (3) of the comparative example. Each of peaks marked with  to an aluminum alloy; each of peaks marked with Δ corresponds to an intermetallic compound $Fe_{12}(SiAl)_{12}$; each of peaks marked with X corresponds to an intermetallic compound $Al_3Zr$; each of peaks marked with □ corresponds to an intermetallic compound $Al_6Fe$, and each of peaks marked with ● corresponds to an intermetallic compound AlZrSi. When each of the aluminum alloys (1) and (3) has a primary crystal Si and an eutectic Si precipitated therein, peaks thereof appear at locations of diffraction angles ≧40°, 46.4°, 67.8°, 81.5° and 86.3°. No such peaks appear in FIG. 5, and, hence, it is evident that Si does not exist in the form of a primary crystal Si.

As apparent from (a) in FIG. 5, intermetallic compounds $Fe_{12}(SiAl)_{12}$, and $Al_3Zr$ were produced in the aluminum alloy of the invention. Such intermetallic compounds, however, are harmless for the toughness of the aluminum alloy. In addition, from the fact that Si is present in the form of a component element of the intermetallic compound, the increasing of toughness of the aluminum alloy (1) of the invention was achieved.

Referring to (b) in FIG. 5, intermetallic compounds $Al_6Fe$ and $Al_3Zr$ are produced in the aluminum alloy (2) of comparative example. The aluminum alloy (2) of the comparative example contains no Si, and, hence, the intermetallic compounds $Al_6Fe$, which are harmful to the toughness, could not be made harmless. Due to this, the aluminum alloy (2) of the comparative example has a low toughness.

Referring to (c) in FIG. 5, intermetallic compounds AlZrSi and $Fe_{12}(SiAl)_{12}$, are produced in the aluminum alloy (3) of the comparative example. The relationship between the Si content (d) and the Fe content (b) is $(d)>(b)/3$, and, hence, the intermetallic compound AlZrSi, which is harmful to the toughness of the alloy, is produced, and due to this, the aluminum alloy (3) of the comparative example has a low toughness. In this case, an intermetallic compound AlZrSi is also produced in an aluminum crystal grain and is especially harmful for the toughness. However, as a result of presence of $Fe_{12}(SiAl)_{12}$, the toughness of the aluminum alloy (3) of the comparative example is higher than that of the aluminum alloy (2) of the comparative example.

Table 2 shows the compositions of other aluminum alloys (4) and (7) of the invention and other aluminum alloys (5), (6) and (8) of comparative examples and the metallographic structures of aluminum alloy blanks. A character a given at a column of metallographic structure in Table 2 means that the metallographic structure is an amorphous single-phase texture, and a+c means that the metallographic structure is a mixed-phase texture. Vf is a volume fraction of each of the amorphous single-phase texture and the mixed-phase texture. The same characters will be used in the subsequent description.

TABLE 2

| Al alloy | Chemical constituent (by atomic %) Al | Fe | Zr | Si | Al alloy blank Me. St. | Vf (%) |
|---|---|---|---|---|---|---|
| (4) | 86 | 9 | 3 | 2 | a | 100 |
| (5) | 88 | 9 | 3 | — | a + c | 100 |
| (6) | 84 | 9 | 3 | 4 | a | 90 |
| (7) | 86 | 8 | 4 | 2 | a | 90 |
| (8) | 88 | 8 | 4 | — | a | 90 |

The process for producing each of the aluminum alloys (4) to (8) was similar to that for each of the aluminum alloys (1) to (3). However, the thermal treatment consisted of conditioning the alloys at a temperature of 450° C. for a period of one hour.

Table 3 shows the relationship between each of the aluminum alloys (4) to (8) and an intermetallic compound contained therein, wherein a "○" mark means that the corresponding intermetallic compound is present.

TABLE 3

| Al alloy | Intermetallic compound $Al_6Fe$ | $Fe_{12}(SiAl)_{12}$ | $Al_3Zr$ | AlZrSi |
|---|---|---|---|---|
| (4) | — | ○ | ○ | — |
| (5) | ○ | — | ○ | — |
| (6) | — | ○ | — | ○ |
| (7) | — | ○ | ○ | — |
| (8) | ○ | — | ○ | — |

It can be seen from Tables 2 and 3 that each of the aluminum alloys (4) and (7) of the invention containing a particular amount of Si contain only the intermetallic compounds $Fe_{12}(SiAl)_{12}$ and $Al_3Zr$, which are harmless to toughness. But each of the aluminum alloys (5) and (8) of the comparative examples containing no Si contain the intermetallic compound $Al_6Fe$, which is harmful to toughness, and the intermetallic compound $Al_3Zr$, harmless to toughness. And the aluminum alloy (6) of the comparative example containing an excess amount of Si contains the intermetallic compound $Fe_{12}(SiAl)_{12}$, which is harmless to toughness, and the intermetallic compound AlZrSi, which is harmful to toughness.

[Example 2]

Table 4 shows the compositions of aluminum alloys (9) to (13) produced with Fe contents varied and with Zr and Si contents fixed; harmful intermetallic compounds in the aluminum alloys; the Vickers hardness Hv and maximum strain $\epsilon f$ of the aluminum alloys; and the metallographic structures of aluminum alloy blanks. The process for producing the aluminum alloys (9) to (13) were substantially similar to that in Example 1. However, the thermal treatment consisted of conditioning the alloys at a temperature of 450° C. for a period of one hour. This producing process is the same for other aluminum alloys in the present embodiment.

TABLE 4

| Al Alloy | Chemical constituent (by atomic %) Al | Fe | Zr | Si | H.I. M.C. | V.H. (Hv) | M.S. ($\epsilon$ f) | Al alloy blank Me. St. | Vf (%) |
|---|---|---|---|---|---|---|---|---|---|
| (9) | 93 | 3 | 3 | 1 | — | 162 | 0.0 | a + c | 35 |
| (10) | 92 | 4 | 3 | 1 | — | 204 | 0.04 | a + c | 80 |
| (11) | 90 | 6 | 3 | 1 | — | 265 | 0.04 | a + c | 100 |
| (12) | 87 | 9 | 3 | 1 | — | 310 | 0.04 | a | 100 |
| (13) | 86 | 10 | 3 | 1 | $Al_6Fe$ | X* | 0.007 | a | 70 |

H.I.M.C. = harmful intermetallic compound
V.H. = Vickers hardness
M.S. = Maximum strain
Me. St. = Metallographic structure
X* means "unmeasurable"

The aluminum alloys (10) to (12) in Table 4 correspond to aluminum alloys of the invention. The aluminum alloy (9) has an Fe content less than 4 atomic % (Fe<4 atomic %) and has a low strength and a low toughness. The aluminum alloy (13) has an Fe content more than 9 atomic % (Fe>9 atomic %), and it has a low strength and an extremely low toughness.

Table 5 shows the compositions of aluminum alloys (14) to (17) produced with Zr contents varied and with Fe and Si contents fixed, and the like. In table 5, a character c means that the metallographic structure is a crystalline single-phase texture.

TABLE 5

| Al Alloy | Chemical constituent (by atomic %) Al | Fe | Zr | Si | H.I. M.C. | V.H. (Hv) | M.S. (ε f) | Al alloy blank Me. St. | Vf (%) |
|---|---|---|---|---|---|---|---|---|---|
| (14) | 92.5 | 6 | 0.5 | 1 | — | 286 | 0.01 | c | — |
| (15) | 92 | 6 | 1 | 1 | — | 233 | 0.05 | a + c | 75 |
| (16) | 91 | 6 | 2 | 1 | — | 250 | 0.04 | a + c | 80 |
| (17) | 88.5 | 6 | 4.5 | 1 | $Al_6Fe$ | 313 | 0.009 | a + c | 80 |

H.I.M.C. = harmful intermetallic compound
V.H. = Vickers hardness
M.S. = Maximum strain
Me. St. = Metallographic structure In Table 5, the aluminum alloys (15) and (16) correspond to aluminum alloys of the invention. The aluminum alloy (14) has a Zr content less than 0.6 atomic % (Zr<0.6 atomic %). As a result, it has a high strength, but a low toughness. The aluminum alloy (17) has a Zr content of more than 4 by atomic % (Zr>4 atomic %), and likewise, it has a high strength, but a low toughness.

Table 6 shows the compositions of two aluminum alloys (18) and (19) produced with Al contents varied and with Fe and Zr content fixed, and the like.

TABLE 6

| Al Alloy | Chemical constituent (by atomic %) Al | Fe | Zr | Si | H.I. M.C. | V.H. (Hv) | M.S. (ε f) | Al alloy blank Me. St. | Vf (%) |
|---|---|---|---|---|---|---|---|---|---|
| (18) | 94.5 | 4 | 0.5 | 1 | — | 164 | 0.04 | a + c | 60 |
| (19) | 94 | 4 | 1 | 1 | — | 201 | 0.05 | a + c | 65 |

H.I.M.C. = harmful intermetallic compound
V.H. = Vickers hardness
M.S. = Maximum strain
Me. St. = Metallographic structure In Table 6, the aluminum alloy (19) corresponds to an aluminum alloy of the invention. The aluminum alloy (18) has an Al content more than 94 atomic % (Al>94 atomic %). As a result, it has a high toughness, but a low strength.

Table 7 shows the compositions of two aluminum alloys (20) and (27) produced with Si contents varied and with Fe and Zr content fixed, and the like.

TABLE 7

| Al Alloy | Chemical constituent (by atomic %) Al | Fe | Zr | Si | H.I. M.C. | V.H. (Hv) | M.S. (ε f) | Al alloy blank Me. St. | Vf (%) |
|---|---|---|---|---|---|---|---|---|---|
| (20) | 91 | 7 | 2 | — | $Al_6Fe$ | 300 | 0.009 | a + c | 90 |
| (21) | 90.5 | 7 | 2 | 0.5 | — | 266 | 0.03 | a + c | 100 |
| (22) | 89 | 7 | 2 | 2 | — | 270 | 0.04 | a + c | 100 |
| (23) | 88.5 | 7 | 2 | 2.5 | AlZrSi | 281 | 0.009 | a + c | 100 |
| (24) | 92 | 6 | 2 | — | $Al_6Fe$ | 262 | 0.01 | a + c | 80 |
| (25) | 91.5 | 6 | 2 | 0.5 | — | 249 | 0.03 | a + c | 80 |
| (26) | 90 | 6 | 2 | 2 | — | 252 | 0.04 | a + c | 85 |
| (27) | 89.5 | 6 | 2 | 2.5 | AlZrSi | 270 | 0.01 | a + c | 90 |

H.I.M.C. = harmful intermetallic compound
V.H. = Vickers hardness
M.S. = Maximum strain
Me. St. = Metallographic structure In Table 7, the aluminum alloys (21), (22), (25) and (26) correspond to aluminum alloys of the invention. The aluminum alloys (20) and (24) contain no Si, and, hence, have a high strength, but a low toughness. The aluminum alloys (23) and (27) have the relationship of (d)>(b)/3 between the Si content (d) and the Fe content (b), and hence, likewise have a high strength, but a low toughness.

FIG. 8 shows the compositions and the like of various aluminum alloys (28) to (31) produced using, as X, at least one element selected from Ni, Fe and Co (but the use of only Fe is eliminated) and with the concentrations of X, Zr and Si fixed.

TABLE 8

| Al Alloy | Chemical constituent (by atomic %) Al | Ni | Fe | Co | Zr | Si | H.I.M.C. | V.H. (Hv) | M.S. (ε f) | Al alloy blank Me. St. | Vf (%) |
|---|---|---|---|---|---|---|---|---|---|---|---|
| (28) | 89 | 2 | 5 | — | 2 | 2 | — | 268 | 0.04 | a + c | 100 |
| (29) | 89 | 7 | — | — | 2 | 2 | — | 250 | 0.05 | a + c | 100 |
| (30) | 89 | — | 5 | 2 | 2 | 2 | — | 271 | 0.03 | a + c | 100 |
| (31) | 89 | — | — | 7 | 2 | 2 | — | 266 | 0.03 | a + c | 100 |

H.I.M.C. = harmful intermetallic compound
V.H. = Vickers hardness
M.S. = Maximum strain
Me. St. = Metallographic structure In Table 8, all the aluminum alloys (28) to (31) correspond to aluminum alloys of the invention.

Table 9 shows the compositions and the like of various aluminum alloys (32) to ($35_1$) produced using, as X, at least one element selected from Fe and Mn, and using, as Z, at least one element selected from Zr and Ti, and with the concentrations of X, Z and Si fixed.

TABLE 9

| Al Alloy | Chemical constituent (by atomic %) Al | Fe | Mn | Zr | Ti | Si | H.I.M.C. | V.H. (Hv) | M.S. (ε f) | Al alloy blank Me. St. | Vf (%) |
|---|---|---|---|---|---|---|---|---|---|---|---|
| (32) | 89 | 5 | 2 | 2 | — | 2 | — | 300 | 0.03 | a + c | 100 |
| (33) | 89 | — | 7 | 2 | — | 2 | — | 302 | 0.03 | a + c | 90 |
| (34) | 89 | 7 | — | 1 | 1 | 2 | — | 275 | 0.04 | a + c | 90 |
| (35) | 89 | 7 | — | — | 2 | 2 | — | 270 | 0.04 | a + c | 85 |
| ($35_1$) | 91.4 | 6 | — | — | 0.6 | 2 | — | 227 | 0.18 | a + c | 90 |

H.I.M.C. = harmful intermetallic compound
V.H. = Vickers hardness
M.S. = Maximum strain
Me. St. = Metallographic structure In Table 9, all the aluminum alloys (32) to ($35_1$) correspond to aluminum alloys of the invention. [Example 3].

Table 10 shows the compositions of an aluminum alloy (36) of the invention and two aluminum alloys (37) and (38) of the comparative examples. The composition of the aluminum alloy (36) of the invention is the same as that of the aluminum alloy (1) of the invention in Example 1, and the compositions of the aluminum alloys (37) and (38) of the comparative examples are the same as those of the aluminum alloys of the comparative examples in Example 1.

TABLE 10

| Al alloy | Chemical constituent (by atomic %) | | | |
|---|---|---|---|---|
| | Al | Fe | Zr | Si |
| (36) | 87 | 8 | 3 | 2 |
| (37) | 89 | 8 | 3 | — |
| (38) | 85 | 8 | 3 | 4 |

In producing each of the aluminum alloys (36) to (38), the process which will be described below was employed. Molten metals having compositions corresponding to those of the three aluminum alloys (36) to (38) were prepared in a high frequency melting process in an argon atmosphere and then used to produce three powdered aluminum alloy blanks (36) to (38) (for convenience, the same characters as the corresponding aluminum alloys are used) by application of a high pressure He gas atomization process. The produced aluminum alloy blanks (36) to (38) were subjected to a classifying treatment, whereby the grain size of each of the aluminum alloy blanks (36) to (38) was adjusted to a level equal to or less than 22 μm. Conditions for the high pressure He gas atomization process were as follows: diameter of a nozzle was 1.5 mm; He gas pressure was 100 kgf/cm$^2$; and temperature of the molten metal was 1,300° C.

The aluminum alloy blanks (36) to (38) were subjected to an X-ray diffraction and a differential scanning calorimeter (DSC) thermal analysis, and results similar to those in FIG. 1 and 2 were obtained. Therefore, the volume fraction Vf of the mixed-phase texture in the metallographic structure of each of the aluminum alloy blanks (36) and (38) was 100%, and the volume fraction Vf of the amorphous single-phase texture in the metallographic structure of the aluminum alloy blank (38) was 100%.

Then, each of the aluminum alloy blanks (36) to (38) was placed into a rubber can and subjected to a CIP (cold isostatic press) under a condition of 4 metric tons/cm$^2$ to produce a billet having a diameter of 50 mm and a length of 60 mm. Each of the billets was placed into a can of aluminum alloy (A5056), and a lid was welded to an opening in the can. A connecting pipe of each of the lids was connected to a vacuum source, and each of the cans was placed in a heating furnace. The interior of each of the cans was evacuated to $2\times10^{-3}$ Torrs, and each of the billets was subjected to a thermal treatment for one hour at 450° C. to crystallize the amorphous phase.

Thereafter, the cans were sealed; placed into a container having a temperature of 450° C.; subjected to a hot extrusion under a condition of an extrusion ratio of about 13 to produce a rounded bar-like aluminum alloy (36) of the invention and aluminum alloys (37) and (38) of comparative examples.

Each of the aluminum alloys (36) to (38) were subjected to a machining operation to fabricate a tensile test piece including a threaded portion of M12 and a parallel portion having a diameter of 5 mm and a length of 20 mm. These test pieces were subjected to a tensile test to give results in Table 11.

TABLE 11

| Al alloy | Result of Tensile Test | | |
|---|---|---|---|
| | Proof (Yield) strength $\sigma$ 0.2 (kgf/mm$^2$) | Tensile strength $\sigma_B$ (kgf/mm$^2$) | Elongation (%) |
| (36) | 89.0 | 96.2 | 4.1 |
| (37) | — | 69.5 | 0 |
| (38) | 92.0 | 92.4 | 0.3 |

It can be seen from Table 11 that the aluminum alloy (36) of the invention has a high strength and a high toughness, as compared with the aluminum alloys (37) and (38) of the comparative examples.

What is claimed is:

1. A high strength and high toughness aluminum alloy produced by crystallization of an aluminum alloy blank having a metallographic structure selected from the group consisting of a mixed-phase texture consisting of an amorphous phase and an aluminum crystalline phase having a volume fraction Vf equal to or greater than 50% (Vf≧50%) and an amorphous single-phase texture having a volume faction Vf equal to or greater than 50% (Vf≧50%), wherein said aluminum alloy is represented by a chemical formula:

$$Al_{(a)}X_{(b)}Z_{(c)}Si_{(d)}$$

wherein X is at least one element selected from the group consisting of Mn, Fe, Co and Ni; Z is at least one element selected from the group consisting of Zr and Ti; and each of (a), (b), (c) and (d) is defined within the following range:

84 atomic %≦(a)≦94 atomic %, 4 atomic %≦(b)≦9 atomic %, 0.6 atomic %≦(c)≦4 atomic %, and 0.5 atomic %≦(d)≦(b)/3, and Si is present in the form of at least one selected from the group consisting of a solute atom of an aluminum solid solution and a component element of an intermetallic compound.

2. A high strength and high toughness aluminum alloy produced by crystallization of an aluminum alloy blank having a metallographic structure selected from the group consisting of a mixed phase texture consisting of an amorphous phase and an aluminum crystalline phase having a volume fraction Vf equal to or greater than 50% (Vf≧50%), and amorphous single-phase texture having a volume fraction Vf equal to or greater than 50% (Vf≧50%), wherein said aluminum alloy is represented by a chemical formula:

$$Al_{(a)}X_{(b)}Z_{(c)}Si_{(d)}$$

wherein X is at least one element selected from the group consisting of Mn, Fe, Co and Ni; Z is at least one element selected from the group consisting of Zr and Ti; and each of (a), (b), (c) and (d) is defined within the following range:

84 atomic %≦(a)≦94 atomic %, 4 atomic %≦(b)≦9 atomic %, 0.6 atomic %≦(c)≦4 atomic %, and 0.5 atomic %≦(d)≦(b)/3.

Si is present in the form of intermetallic compound $X_{12}(SiAl)_{12}$.

* * * * *